US008240251B2

(12) United States Patent
Waddell et al.

(10) Patent No.: US 8,240,251 B2
(45) **Date of Patent: *Aug. 14, 2012**

(54) REACTIVE SHAPED CHARGE, REACTIVE LINER, AND METHOD FOR TARGET PENETRATION USING A REACTIVE SHAPED CHARGE

(75) Inventors: Jesse T. Waddell, Tucson, AZ (US); Thomas H. Bootes, Tucson, AZ (US); George Darryl Budy, Tuscon, AZ (US); Richard K. Polly, Tucson, AZ (US); Jason M. Shire, Tucson, AZ (US); Wayne Lee, Vail, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/269,219

(22) Filed: Oct. 7, 2011

(65) Prior Publication Data

US 2012/0024180 A1 Feb. 2, 2012

Related U.S. Application Data

(63) Continuation of application No. 12/336,796, filed on Dec. 17, 2008, now Pat. No. 8,037,829.

(60) Provisional application No. 61/060,632, filed on Jun. 11, 2008.

(51) Int. Cl.
*F42B 1/00* (2006.01)

(52) U.S. Cl. ..... 102/306; 102/476; 102/499

(58) Field of Classification Search ..... 102/306, 102/476, 499
See application file for complete search history.

(56) References Cited

U.S. PATENT DOCUMENTS

| | | | |
|---|---|---|---|
| 6,186,070 | B1 | 2/2001 | Fong et al. |
| 7,156,024 | B2 | 1/2007 | Ronn et al. |
| 7,712,416 | B2 | 5/2010 | Pratt et al. |
| 7,819,064 | B2 | 10/2010 | Saenger et al. |
| 8,037,829 | B1 | 10/2011 | Waddell et al. |
| 2006/0266551 | A1 | 11/2006 | Yang |

OTHER PUBLICATIONS

"U.S. Appl. No. 12/336,796, Non Final Office Action mailed Apr. 4, 2011", 7 pgs.
"U.S. Appl. No. 12/336,796, Notice of Allowance mailed Jul. 1, 2011", 5 pgs.
"U.S. Appl. No. 12/336,796, Response filed May 23, 2011 to Non Final Office Action mailed Apr. 4, 2011", 9 pgs.

*Primary Examiner* — J. Woodrow Eldred
(74) *Attorney, Agent, or Firm* — Schwegman, Lundberg & Woessner, P.A.

(57) ABSTRACT

Embodiments of a reactive shaped charge, a reactive liner, and a method for penetrating a target are generally described herein. The reactive shaped charge comprises a reactive liner having a matrix of reactive metal particles in a hydrocarbon fuel, a high explosive, and an inner barrier separating the reactive liner from the high explosive. The hydrocarbon fuel fills the interstitial spacing between the reactive metal particles, and the matrix is tightly packed or compresses to exhibit a solid like property.

15 Claims, 6 Drawing Sheets

FIG. 2E
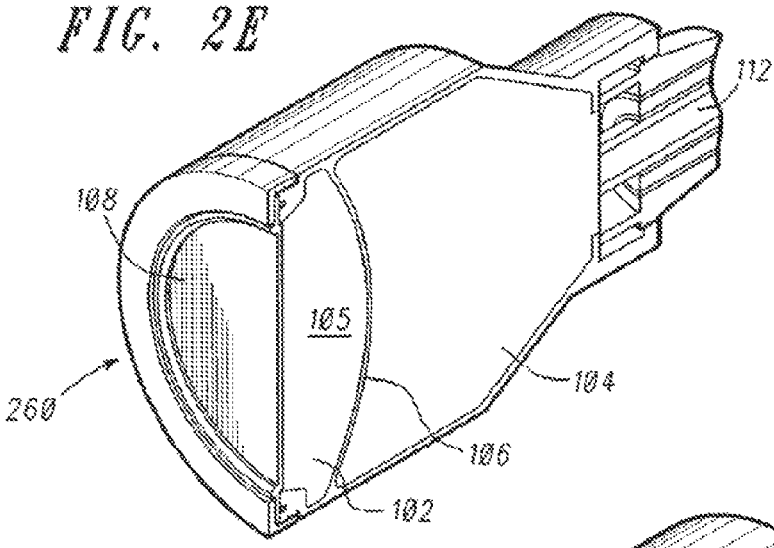
FIG. 2F
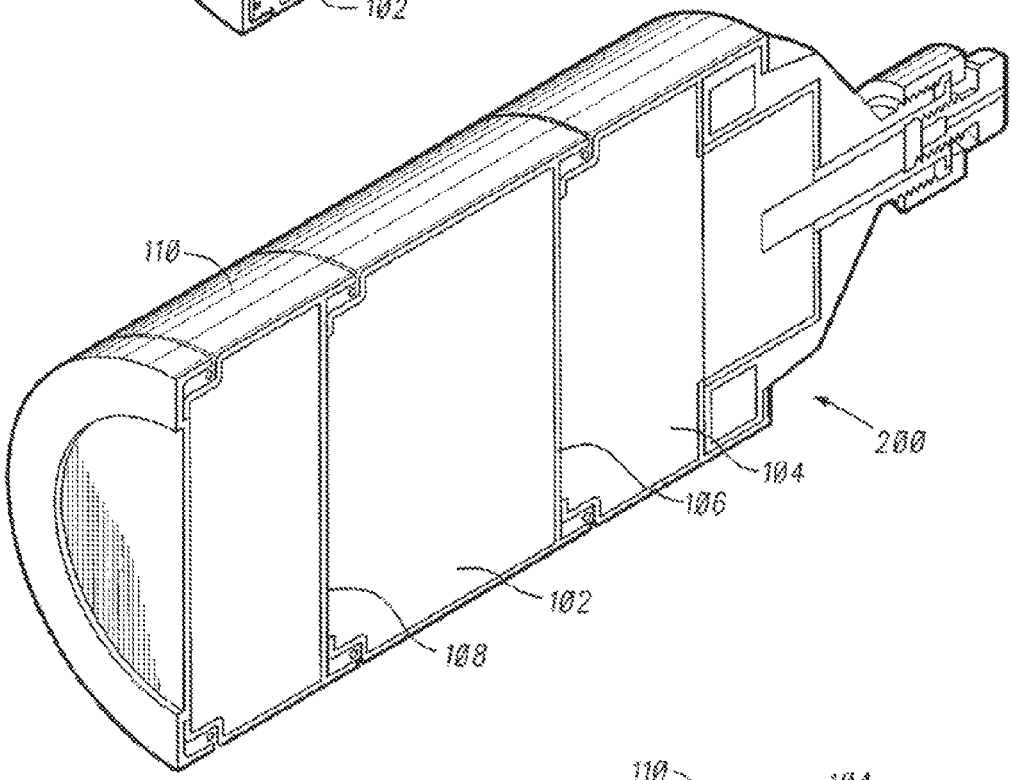
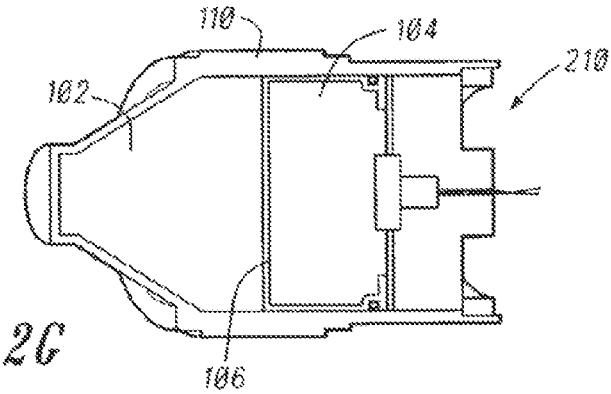
FIG. 2G

REACTIVE SHAPED CHARGE, REACTIVE LINER, AND METHOD FOR TARGET PENETRATION USING A REACTIVE SHAPED CHARGE

CROSS-REFERENCE TO RELATED APPLICATIONS

This patent application is a continuation of and claims the benefit of priority under 35 U.S.C. §120 to U.S. patent application Ser. No. 12/336,796, filed on Dec. 17, 2008, and now issued as U.S. Pat. No. 8,037,829, which claims the benefit of priority under 35 U.S.C. §119(e) to U.S. Provisional Patent Application Ser. No. 61/060,632, filed Jun. 11, 2008 entitled "APPARATUS AND METHODS FOR REACTIVE SHAPED CHARGE", the entire contents of which are incorporated herein by reference in its entirety.

TECHNICAL FIELD

Some embodiments pertain to reactive shaped charges and shaped-charge warheads. Some embodiments pertain to reactive materials. Some embodiments pertain to reactive liners suitable for use in lined shaped charges. Some embodiments pertain to warheads and precision lethal technology.

BACKGROUND

A lined shaped charge generates an enormous amount of pressure by detonation of an explosive to drive a liner to penetrate a target. In conventional shaped charges, the residual liner material perforates a target's protective barrier and enters a confined target space. Because many conventional shaped charges use inert liner material, the residual liner material deposits only a small amount of energy, in the form of heat and pressure, before exiting the target. Conventional penetrating warheads require allocation of substantial warhead mass to survive an impact with a target and to perforate a protective target barrier to enable detonation of energetic materials within the target space.

Thus, what are needed are reactive shaped charges that are capable of perforating protective target barriers followed by signification energy release inside the confined target space. What are also needed are reactive liners suitable for use in shaped charges, and warheads that maximize the allocation of payload mass to the energetic verses inert material components.

BRIEF DESCRIPTION OF THE DRAWINGS

FIGS. 2A-2E illustrate shaped charges with shaped reactive liners in accordance with various embodiments;

FIGS. 2F-2H illustrate warheads with reactive liners in accordance with various stacked configuration embodiments;

DETAILED DESCRIPTION

The following description and the drawings sufficiently illustrate specific embodiments to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in, or substituted for, those of other embodiments. Embodiments set forth in the claims encompass all available equivalents of those claims.

Figure 1:
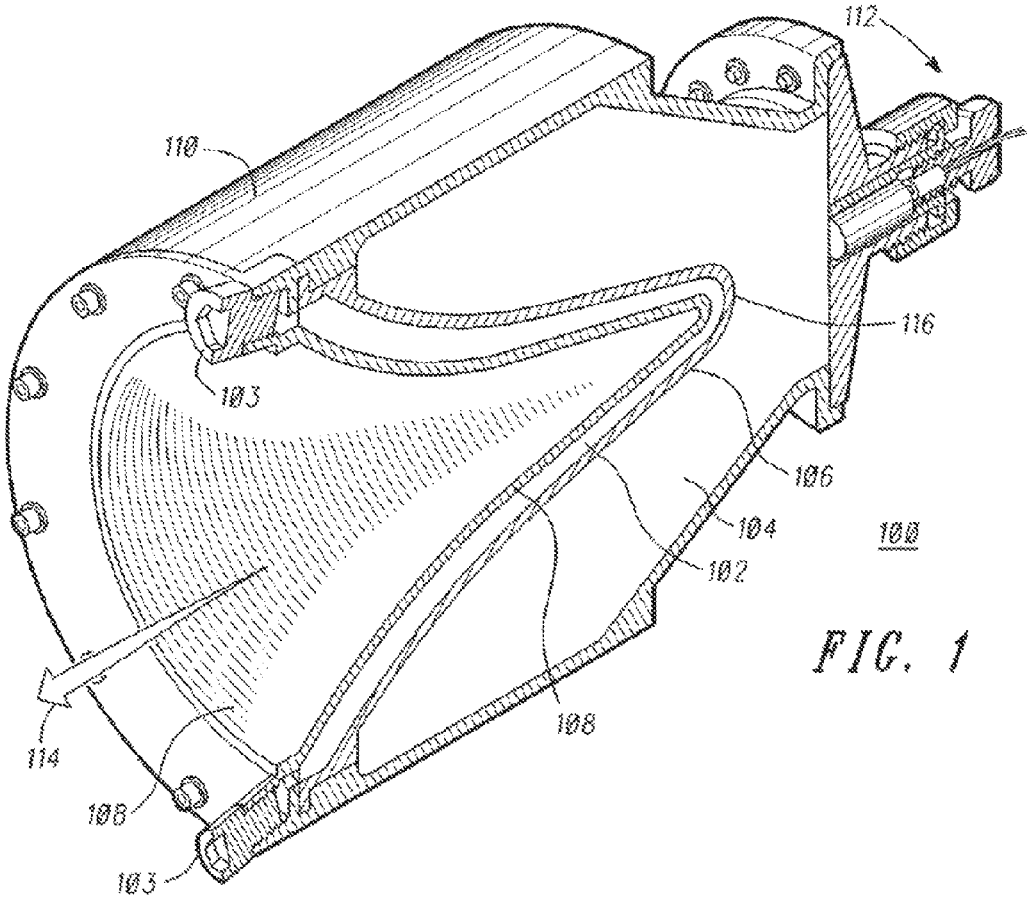
FIG. 1 illustrates a reactive shaped charge in accordance with some embodiments.

FIG. 1 illustrates a reactive shaped charge in accordance with some embodiments. Reactive shaped charge 100 includes reactive liner 102, high explosive 104, and inner barrier 106 separating reactive liner 102 from high explosive 104. In accordance with some embodiments, reactive liner 102 may comprise a matrix of reactive metal particles in a hydrocarbon fuel. Reactive liner 102 may be provided in a sealed region 105 between outer barrier 108 and inner barrier 106. Reactive shaped charge 100 may also include detonator 112 and casing 110 as illustrated, as well as other elements associated with conventional shaped charges.

In accordance with some embodiments, the hydrocarbon fuel fills the interstitial spacing between the reactive metal particles to provide the matrix that comprises reactive liner 102. The matrix may be tightly packed to exhibit a solid property and so as to retain its shape unsupported by any structural housing exhibiting a non-liquid quality (i.e., a solid or solid-like property).

In some embodiments, reactive liner 102 is free of oxidant. In these embodiments, because the reactive liner is free from and devoid of an oxidant, any reaction may be delayed until liner 102 is dispersed and exposed to oxygen in the confined space of the target.

In some alternate embodiments, reactive liner 102 may include an oxidant, such as ammonium perchlorate or a synthetic fluoro-polymer, although the scope of the embodiments is not limited in this respect. Examples of synthetic fluoro-polymers include poly-tetra-fluoro-ethylene or poly-tetra-fluoro-ethene (PTFE).

In some embodiments, the reactive metal particles of the matrix may comprise a single reactive metal selected from the group consisting of aluminum, magnesium, zirconium, titanium and boron. In these embodiments, almost any metal that reacts with air or oxygen may be used. In some embodiments, metalloids may be used. Metalloids may have properties of both metals and non-metals.

In some alternate embodiments, the reactive metal particles may comprise two or more reactive metals selected from the group consisting of aluminum, magnesium, zirconium, titanium and boron. The two or more metals may be selected for reactive burn rate and matrix effective density, although the scope of the embodiments is not limited in this respect. In these embodiments, metalloids may also be used.

In some embodiments, sealed region 105 provided between inner barrier 106 and outer barrier 108 may be hermetically sealed, although the scope of the embodiments is not limited in this respect.

In some embodiments, inner barrier 106 and outer barrier 108 may have a trumpet-like shape (as shown in FIG. 1) to provide reactive liner 102 in a trumpet-like shape with apex 116 toward detonator 112. When high explosive 104 is detonated, reactive liner 102 may form a jet directed in direction 114 (i.e., toward a target). The matrix of reactive metal particles and hydrocarbon fuel may disperse and mix with ambient air within a target space and may then rapidly combust after perforation of a protective target barrier.

In some embodiments, reactive liner 102 may be configured to have a low effective shear strength in tension. In these embodiments, the effective shear strength of reactive liner 102 may be lower than some conventional liners that, for example, include metal particles suspended in a wax. In accordance with embodiments of the present invention, reactive liner 102 may act like a liquid (shear flow) under high pressure (e.g., when high explosive 104 ignites).

In some embodiments, reactive shaped charge 100 may include one or more liner fill ports 103 to allow sealed region 105 to be filled with the matrix of reactive metal particles and hydrocarbon fuel. Sealed region 105 may be filled through liner fill ports 103 by performing a process that includes pouring the matrix of reactive metal particles and hydrocarbon fuel into region 105 through liner fill ports 103. The process may also include waiting for the reactive metal particles to settle and for excess liquid comprising the hydrocarbon fuel to form on a top surface near liner fill ports 103. The process may also include removing the excess liquid and/or the pouring, waiting and removing until region 105 is completely filled and/or until the density of the matrix is maximized. In some embodiments, this "settling-out" process may include pressing or compressing the matrix to help maximize or customize the density. Once region 105 is completely filled and/or the density of the matrix is maximized, the matrix may exhibit a solid property.

In some embodiments, the matrix may be initially provided in a slurry form with a lower density and steps of the process may be repeated to increase the density of the matrix or until a minimum density (e.g., between 2 and 4 g/cc) is achieved. In these embodiments, the hydrocarbon fuel may be in a liquid state, although the scope of the embodiments is not limited in this respect. In other embodiments, the hydrocarbon fuel may be in a gas state. In other embodiments, the matrix may be provided in a higher density form in which the matrix is compressed to reduce the interstitial spacing between the metal particles and displace the lower density hydrocarbon fuel.

In some alternate embodiments, a pressing operation may be performed to pre-form solid liners from the matrix. These pre-formed solid lines may be installed in a shaped charge. Alternatively, a pressing operation may be performed "in-situ" to form the solid liner in the shaped charge, although the scope of the embodiments is not limited in this respect.

In the alternate embodiments that reactive liner 102 includes an oxidant, the oxidant may be mixed in with the metal particles and the hydrocarbon fuel before the settling out and/or pressing operations described above.

In some embodiments, inner barrier 106 may comprise metallic material, such as copper, aluminum, titanium, and tantalum. In some other embodiments, inner barrier 106 may comprise a non-metallic material, such as nylon. In some embodiments, outer barrier 108 may comprise copper, aluminum, titanium, and tantalum. In some embodiments, high explosive 104 may be a HMX based composition, such as PBXN-110, or may comprise RDX based compositions although other high explosives may also be suitable. In some embodiments, the hydrocarbon fuel used in reactive liner 102 may comprise a jet fuel such as JP-5, JP-8 or JP-10, although other fuels, such as kerosene, gasoline and diesel may also be suitable.

Although reactive liner 102 is illustrated in FIG. 1 as having a trumpet-like shape, the scope of the embodiments is not limited in this respect as reactive liner 102 may be configured to have almost any shape. Some of these other embodiments are described in more detail below. Reactive shaped charge 100, as well as the various embodiments that use reactive liner 102 discussed below, may be suitable for use as a warhead in guided and unguided anti-tank missiles, spun and unspun gun-fired projectiles, rifle fired grenades, mines bomblets, torpedoes as well as other launched projectiles and missiles.

Figure 2A:
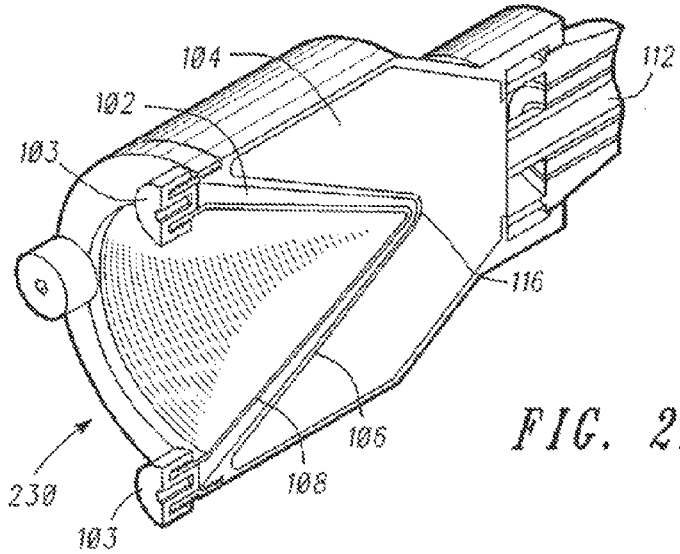

FIG. 2A illustrates shaped charge 230 with a conical-shaped reactive liner 102 in accordance with some embodiments. Shaped charge 230 includes reactive liner 102, high explosive 104, and inner barrier 106 separating reactive liner 102 from high explosive 104. Reactive liner 102 may comprise a matrix of reactive metal particles in a hydrocarbon fuel as discussed above. In shaped charge 230, both inner barrier 106 and outer barrier 108 have conical shapes with differing apex angles to define reactive liner 102 having a conical shape with apex 116 toward detonator 112. Shaped charge 230 may also include fill ports 103.

Figure 2B:
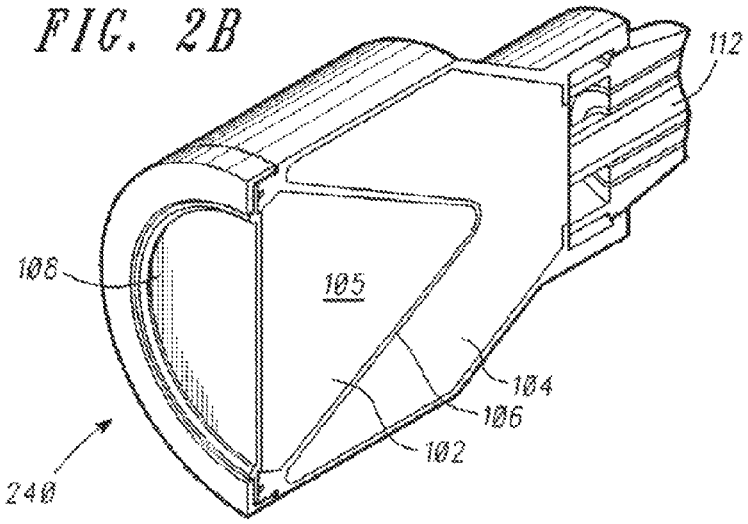

FIG. 2B illustrates shaped charge 240 with a conical-shaped reactive liner in accordance with some other embodiments. Reactive shaped charge 240 includes reactive liner 102, high explosive 104, inner barrier 106 separating reactive liner 102 from high explosive 104, and detonator 112. Reactive liner 102 may comprise a matrix of reactive metal particles in a hydrocarbon fuel as discussed above. In these embodiments, inner barrier 106 has a conical shape and outer barrier 108 provides a flat base to define reactive liner 102. In these embodiments, sealed region 105 may comprise a volume of a cone.

Figure 2C:
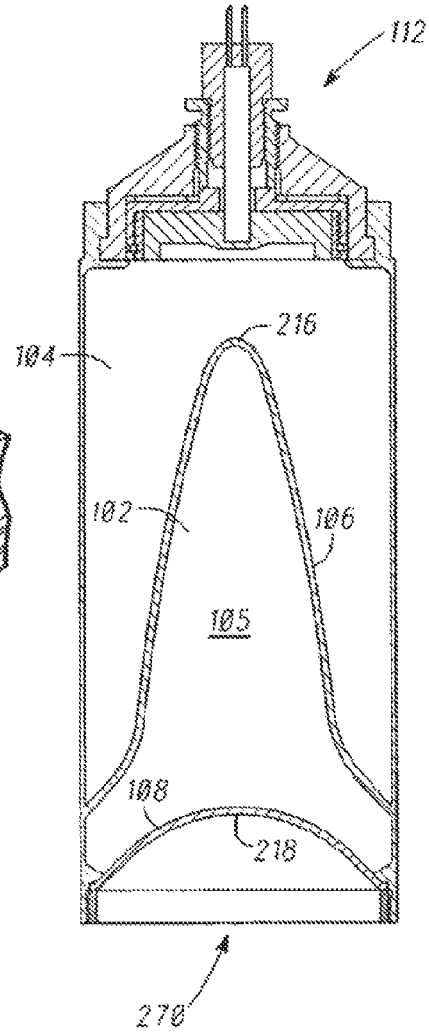

FIG. 2C illustrates shaped charge 270 with a shaped reactive liner in accordance with some embodiments. Reactive shaped charge 270 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, inner barrier 106 has a trumpet-like shape and outer barrier 108 has hemispherical shape 218 to define sealed region 105 that comprises reactive liner 102. Apex 216 of inner barrier 106 is nearer detonator 112 as shown. In some embodiments, shaped charge 270 may include fill ports (not illustrated).

Figure 2D:
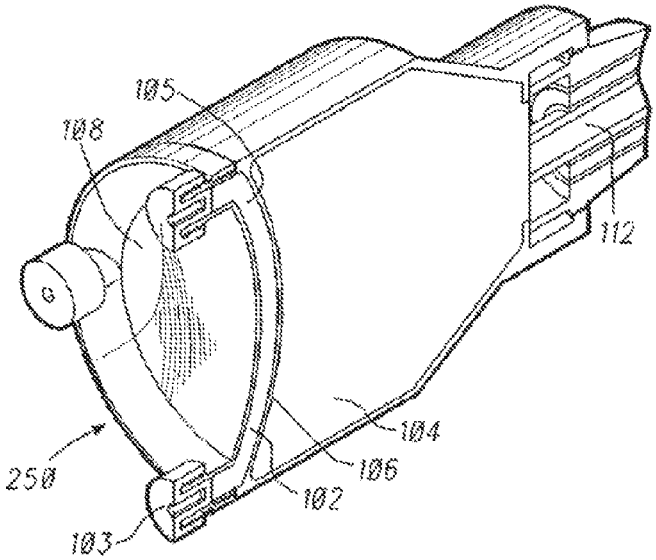

FIG. 2D illustrates shaped charge 250 with a shaped reactive liner in accordance with some embodiments. Reactive shaped charge 250 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, both inner barrier 106 and outer barrier 108 have a curved (e.g., hemispherical) shape as shown to define sealed region 105 that comprises reactive liner 102. In these embodiments, reactive liner 102 may have a curved shape that is convex with respect to detonator 112. In some embodiments, shaped charge 250 may also include fill ports 103.

FIG. 2E illustrates shaped charge 260 with a shaped reactive liner in accordance with some embodiments. Reactive shaped charge 260 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, inner barrier 106 may have a curved (e.g., hemispherical) shape and outer barrier 108 may be substantially flat to define sealed region 105. In these embodiments, the curved shape of inner barrier 106 may be convex with respect to detonator 112.

FIG. 2F illustrates warhead 200 with a reactive liner in accordance with stacked configuration embodiments. Warhead 200 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, reactive liner 102 and high explosive 104 are arranged in a stacked configuration as illustrated within casing 110. In these embodiments, inner barrier 106 and outer barrier 108 are substantially flat.

FIG. 2G illustrates warhead 210 with a reactive liner in accordance with some other stacked configuration embodiments. Warhead 210 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, reactive liner 102 and high explosive 104 are arranged in a stacked configuration within casing 110. In these embodiments, inner barrier 106 is flat. These embodiments may be referred to as bunker buster embodiments and are described in more detail below.

Figure 2H:
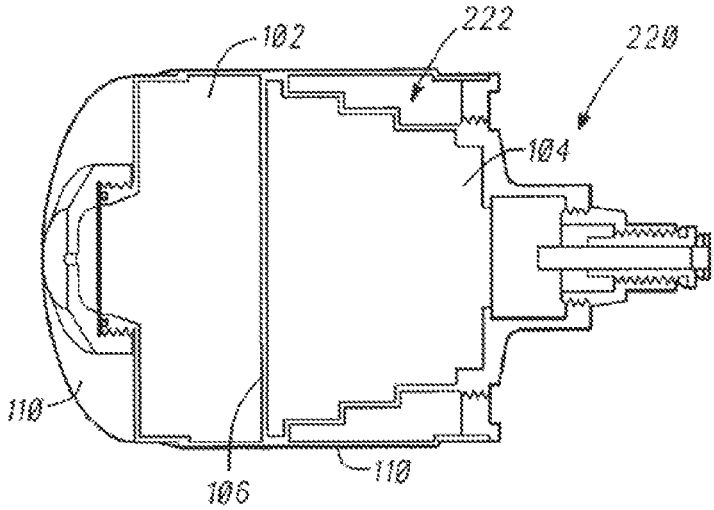

FIG. 2H illustrates warhead 220 with a reactive liner in accordance with some other stacked configuration embodiments. Warhead 220 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, reactive liner 102 and high explosive 104 are arranged in a stacked configuration within casing 110. In these embodiments, inner barrier 106 is flat. In some of these embodiments, pre-formed metal shapes 222 may be provided for fragmentation effects on a target within an outer region of casing 110 (i.e., outside the region containing the high explosive 104). In some embodiments, pre-formed metal shapes 222 may comprise a plurality of steel and aluminum balls may have a diameter of approximately a quarter inch, although the scope of the embodiments is not limited in this respect.

Figure 3A:
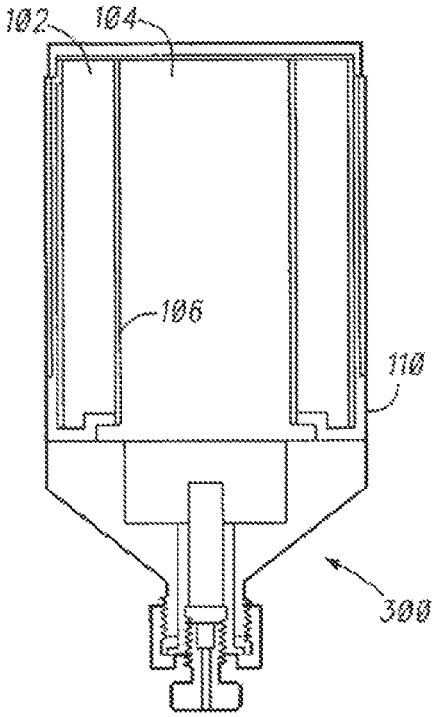
FIGS. 3A and 3B illustrate side and perspective views of a warhead with a reactive liner in accordance with some embodiments.
Figure 3B:
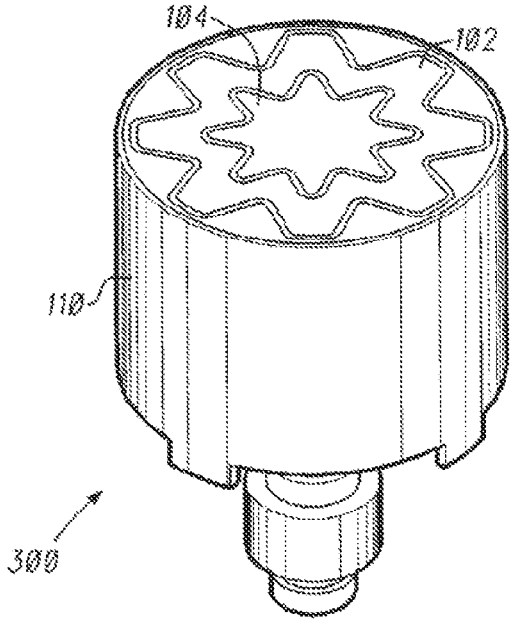

FIGS. 3A and 3B illustrate side and perspective views of warhead 300 with a reactive liner in accordance with some embodiments. Warhead 300 includes reactive liner 102, high explosive 104, and inner barrier 106 separating reactive liner 102 from high explosive 104. Reactive liner 102 may comprise a matrix of reactive metal particles in a hydrocarbon fuel as discussed above. In these embodiments, reactive liner 102 may have a star-like cylindrical shape provided longitudinally within casing 110 of warhead 300 as illustrated. In these embodiments, high explosive 104 may comprise an inner star-like cylindrical region and reactive liner 102 may comprise an outer star-like cylindrical region as illustrated.

Figure 4A:
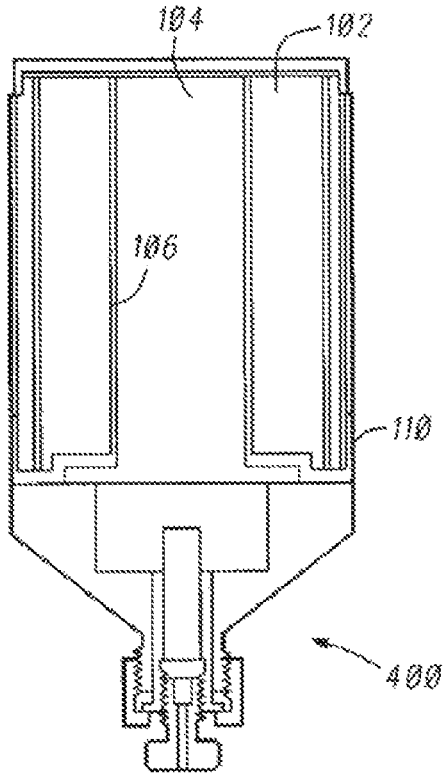
FIGS. 4A and 4B illustrate side and perspective views of a warhead with a reactive liner in accordance with some other embodiments.
Figure 4B:
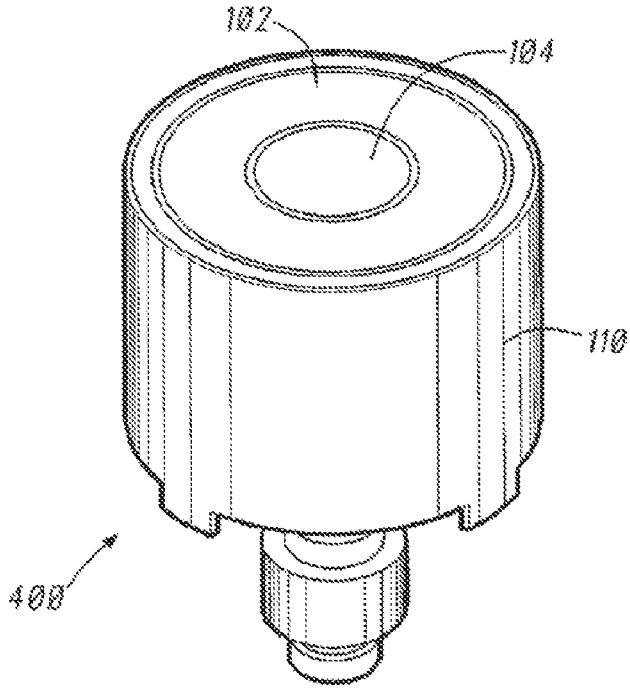

FIGS. 4A and 4B illustrate side and perspective views of warhead 400 with a reactive liner in accordance with some other embodiments. Warhead 400 includes reactive liner 102, high explosive 104, and an inner barrier 106 separating reactive liner 102 from high explosive 104. Reactive liner 102 may comprise a matrix of reactive metal particles in a hydrocarbon fuel as discussed above. In these embodiments, reactive liner 102 and high explosive 104 may be arranged in a cylindrical configuration provided longitudinally within casing 110 of warhead 400. In these embodiments, high explosive 104 may comprise an inner cylindrical region and reactive liner 102 may comprise an outer cylindrical region as illustrated.

Figure 5:
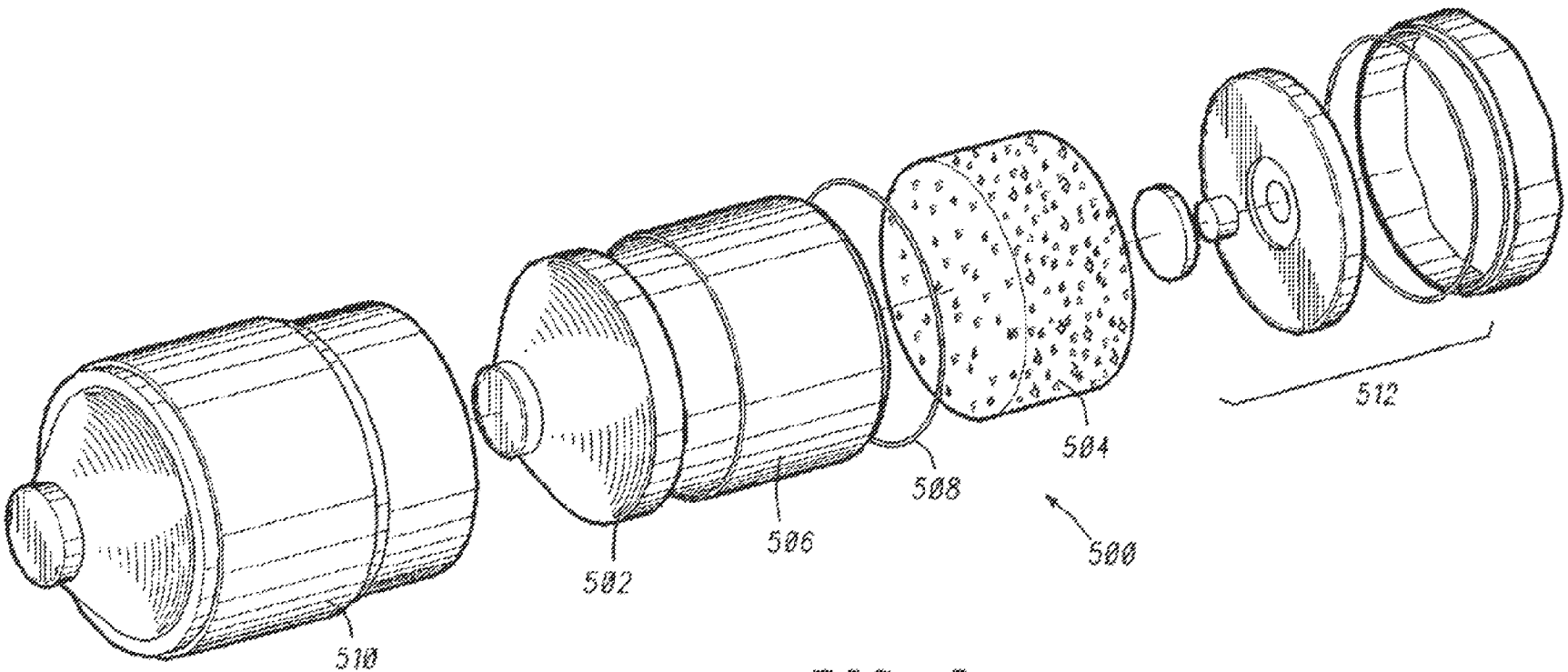
FIG. 5 illustrates an exploded view of a hyperbaric TOW Bunker Buster warhead in accordance with some embodiments.

FIG. 5 illustrates an exploded view of a hyperbaric TOW Bunker Buster warhead in accordance with some embodiments. Warhead 500 includes case 510, reactive liner 502, canister 506 to hold high explosive 504, and o-ring 508 to seal canister 506. Reactive liner 502 may comprise a matrix of reactive metal particles in a hydrocarbon fuel as discussed above. Warhead 500 may also include igniter 512, which may be referred to as an initiation assembly. Warhead 500 may correspond to warhead 210 (FIG. 2G) in which reactive liner 502 may correspond to reactive liner 102 (FIG. 2G) and high explosive 504 may correspond to high explosive 104 (FIG. 2G).

Some embodiments of the present invention provide a reactive liner for use in a shaped charge or warhead. In these embodiments, the reactive liner comprises a matrix of reactive metal particles in a hydrocarbon fuel. The hydrocarbon fuel fills in the interstitial spacing between the reactive metal particles. The matrix may be tightly packed or compressed to exhibit a solid property. In some embodiments, the reactive liner may be free of oxidant. In alternate embodiments, the reactive line may include an oxidant.

In some embodiments, a method for penetrating a target with a reactive shaped charge is provided. In these embodiments, the reactive shaped charge may include a reactive liner, such as reactive liner 102, and a high explosive. The method may include launching the reactive shaped charge toward a target and detonating the high explosive. The detonation of the high explosive may cause the reactive liner to form a high velocity jet to perforate protective target barriers and to disperse and mix with air in a target space followed by a rapid combustion of the mixture of the reactive metal particles, the hydrocarbon fuel and the air. In these embodiments, the reactive liner may comprise a matrix of reactive metal particles in a hydrocarbon fuel as discussed above and may be provided in a sealed region. The hydrocarbon fuel may fill the interstitial spacing between the reactive metal particles. The matrix of the reactive metal particles and the hydrocarbon fuel may be tightly packed to exhibit a solid property.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A reactive liner for use in a shaped charge, the reactive liner comprising:

a matrix of reactive metal particles in a gaseous hydrocarbon fuel; and a high explosive; and wherein the gaseous hydrocarbon fuel fills an interstitial spacing between the reactive metal particles.

2. The reactive liner of claim 1 wherein the barrier is an inner barrier and the reactive liner is in a hermetically sealed region between the inner barrier and an outer barrier.

3. The reactive liner of claim 1 wherein the reactive liner is formed by a pressing operation to pre-form the matrix in a shape for installation in the shaped charge.

4. The reactive liner of claim 1 wherein the reactive liner is formed by a pressing operation to form the reactive liner from the matrix within the shaped charge.

5. The reactive liner of claim 1 wherein the reactive liner includes an oxidant.

6. The reactive liner of claim 1 wherein the reactive metal particles comprise a single reactive metal selected from the group consisting of aluminum, magnesium, zirconium, titanium and boron.

7. A reactive shaped charge comprising:

a reactive liner comprising a matrix of reactive metal particles in a gaseous hydrocarbon fuel;

a high explosive; and an inner barrier separating the reactive liner from the high explosive.

8. The shaped charge of claim 7 further comprising an outer barrier such that the reactive liner is positioned in a hermetically sealed region between the outer barrier and the inner barrier.

9. The reactive liner of claim 7 wherein the reactive liner includes an oxidant.

10. The shaped charge of claim 7 wherein the reactive metal particles comprise a single reactive metal selected from the group consisting of aluminum, magnesium, zirconium, titanium and boron.

11. The shaped charge of claim 7 wherein the reactive metal particles comprise two or more reactive metals selected from the group consisting of aluminum, magnesium, zirconium, titanium and boron.

12. The shaped charge of claim 7 wherein the liquid hydrocarbon fuel fills in an interstitial spacing between the reactive metal particles.

13. A method of producing a shaped charge, the method comprising:

forming a matrix of reactive metal particles; and filling an interstitial spacing between the reactive metal particles with a hydrocarbon fuel to form a reactive liner by pouring a liquid hydrocarbon fuel between the inner barrier and an outer barrier;

placing the reactive liner on one side of an inner barrier;

placing a high explosive on an opposing side of the inner barrier; and compressing the reactive metal particles to form the matrix within the shaped charge and bleed out excess liquid hydrocarbon fuel.

14. The method of claim 13 wherein placing the reactive liner on one side of an inner barrier includes placing the reactive liner between the inner barrier and an outer barrier.

15. The method of claim 14 wherein filling an interstitial spacing between the reactive metal particles with a liquid hydrocarbon fuel includes forming a slurry of the reactive metal particles and the liquid hydrocarbon fuel such that placing the reactive liner between the inner barrier and an outer barrier includes pouring the slurry between the inner barrier and an outer barrier.

* * * * *